US006532611B1

(12) United States Patent
Day

(10) Patent No.: US 6,532,611 B1
(45) Date of Patent: Mar. 18, 2003

(54) EVERTABLE TRAVEL PILLOW

(76) Inventor: Judy A. Day, 343 Soquel Ave. #271, Santa Cruz, CA (US) 95062

( * ) Notice: Subject to any disclaimer, the term of this patent is extended or adjusted under 35 U.S.C. 154(b) by 0 days.

(21) Appl. No.: 10/057,006

(22) Filed: Jan. 25, 2002

(51) Int. Cl.[7] ..... A47G 9/00
(52) U.S. Cl. ..... 5/636; 5/640; 5/644; 5/951
(58) Field of Search ..... 5/636, 640, 644, 5/645, 654, 655.4, 911, 490, 951

(56) References Cited

U.S. PATENT DOCUMENTS 1,068,355 A * 7/1913 McComb ..... 5/640
1,386,652 A * 8/1921 Patton ..... 5/640
1,447,288 A * 3/1923 Emmerich ..... 5/645
2,500,974 A * 3/1950 Angert ..... 5/645
2,589,013 A * 3/1952 Martin ..... 297/391
2,765,480 A * 10/1956 Mueller ..... 5/640
3,327,330 A * 6/1967 McCullough ..... 5/640
3,604,026 A * 9/1971 Scheips ..... 5/640 X
4,738,488 A * 4/1988 Camelio ..... 5/640 X
4,768,247 A * 9/1988 Beier ..... 5/640
5,205,611 A * 4/1993 Stephens ..... 5/640 X
5,271,114 A * 12/1993 Kjersem ..... 5/640
5,297,304 A * 3/1994 O'Sullivan ..... 5/636 X
5,363,524 A * 11/1994 Lang ..... 5/640
5,535,467 A * 7/1996 Ciske ..... 5/636
5,920,933 A * 7/1999 Chou ..... 5/636
6,009,577 A * 1/2000 Day ..... 5/636
6,023,798 A * 2/2000 Hui ..... 5/490

* cited by examiner

*Primary Examiner*—Robert G. Santos

(57) ABSTRACT

Geometric configuration transformable pillows are disclosed having two configurations: one, where the granular fill contents of the pillow are positioned in a first geometric configuration end, in one embodiment a collar end, of a pillowcase to form for example a horseshoe-shaped type of pillow enclosure similar to neck pillows known at this time. Alternately, an empty main body flap of the pillowcase may be released by a reversible fastening system and fill material allowed to move to a second geometric configuration end, in one embodiment a plain end, of the pillow so that two tubular end sections which formerly formed the collars of the neck pillow are now empty and can be at least partially everted and folded, rolled, or otherwise bunched up and captured by the now oppositely turned reversible fastening system within the pillowcase to form a rectangular-type pillow. It is expected that such a pillow would be used with organic granular-type fill materials, such as buckwheat husks (hulls).

22 Claims, 7 Drawing Sheets

EVERTABLE TRAVEL PILLOW

FIELD OF THE INVENTION

This invention relates to pillows for the neck and upper spine, used for traveling and sleeping. In particular to a pillow that is reversible between a neck supporting horseshoe configuration and a rectangular outline common pillow where in each configuration a continuous outer surface of the pillowcase makes that configuration of the reversible pillow nearly indistinguishable from pillows of similar configurations which are not convertibly reversible.

BACKGROUND OF THE INVENTION

Travelers who are forced to sit for a long time in an upright posture have long struggled with obtaining adequate neck support so that back or neck problems do not appear or become worse as a result of their having to sit for a long time in planes, cars, or trains. As a result of this problem, a neck pillow 20 as shown in FIGS. 1 to 4, has been developed. It is a horseshoe-shaped collar which, quite often, is an inflatable structure and, more recently, has been filled with foam, feathers, or organic granular or bark-type materials. Side and top views of the conventional neck pillow are shown in FIGS. 3 and 4. FIG. 1 shows the use of a neck pillow by the traveler sitting in an upright seat. The pillow, ideally, fits around the neck and sits on the shoulders and supports the back of the neck to prevent the head from tilting sharply to one side, so that any hinging of the neck (such as might occur when a person nods off to sleep) is minimized. However, unless an inflatable pillow (which is generally considered by most travelers to be not very useful) is used, once the traveling time is over, a horseshoe-shaped travel pillow becomes a weight to be carried around and stored until the next usage.

The use of such a pillow for sleeping on a horizontal surface, for example, as shown in FIG. 5, is contrary to popular experience where a plain, rectangular-type pillow 22, a perspective view of which is shown in FIG. 6 (a side view of which is shown in FIG. 7) supports the head of a sleeping person 24 as shown in FIG. 5. The conventional-type pillow 22, as shown in FIG. 6, has all the disadvantages of a standard airline-type pillow, namely, that it does not remain propped on one's shoulders but slides down one's back every time one leans forward. It is not an acceptable alternative for the most demanding travelers.

Travelers had been faced with the issue of whether they want to take along a pillow which is good for their neck and back and then have to carry it around and store it within their luggage until the next seated usage. Travelers were interested in having a pillow which they may use both for traveling and also in other instances, for example which could be used in a normal horizontal sleep configuration that provides them better neck support and a more consistent night's rest lying horizontally, and which also maintains the advantages of a travel-type neck pillow when they are traveling. Then in 2000 U.S. Pat. No. 6,009,577 issued, and is incorporated herein by reference, it discloses an invention of one of the inventors of the present application, a transformable pillow that utilizes a particular volumetric pillow case configuration and a selected amount of flowable fill material to provide two configurations, each configuration closed by a fastening a flap of unfilled pillow case material on or to a side surface of the filled portion of the pillow case. The present invention provides an improvement over the side flap arrangement of that earlier design in that the side flap of the earlier design was subject to the holding power of the fasteners used and their resistance to outside rubbing and normal usage forces to maintain the desired configurations. External buttons and snaps would become loose and could break, which created a nuisance to the user during the use and or transport of the transformable pillow. The present invention implements a solution which substantially eliminates the need for a variety of fasteners to maintain their holding power and eliminates the presence of fasteners on the side surface of the pillow where they are likely to come in contact with a pillow user's face which thereby provides an elegant solution which when implemented is almost indistinguishable from pillows in either of the two configurations (travel and rectangular; or between one preferred shape and another, such as a circular pillow and a square pillow) between which a configuration according to the invention is transformable.

SUMMARY OF THE INVENTION

The present invention provides a transformable travel pillow which utilizes granular or flowable material within a pillowcase which is configured to be folded in one of two configurations so that, in one configuration, the pillow fill is relatively firm and is contained within a collar end of a pillowcase opposite a plain end of a pillowcase. The pillowcase at the collar end includes two tubular collar sections extending approximately in the same direction with a saddle section, sized to receive the neck of a person, between the two tubular collar sections. This configuration of the invention is like the horseshoe shape of the neck pillow previously described.

The relationship of the flowable or granular fill material within the pillowcase is such that when the granular fill material is positioned to substantially fill a collar end of the pillowcase, the two tubular collar sections of the pillowcase including a saddle section, are substantially full of granular material, while granular fill material is substantially absent from the plain end of the pillowcase, such that a plain end flap of the pillowcase can be at least partially everted and positioned within the collar end of the pillowcase and the two sides of a reversible fastening mechanism system joined to capture and hold the at least partially everted plain end flap of the pillowcase and the granular fill material in the collar end of the pillowcase.

Alternately, when the granular fill material is positioned to substantially fill a plain end of the pillowcase, the plain end of the pillowcase is substantially full of granular material, while granular fill material is substantially absent from two tubular collar sections at a collar end of the pillowcase, such that a collar end flap including the collar sections of the pillowcase can be at least partially everted and positioned within the plain end of the pillowcase and the two sides of a reversible fastening mechanism system joined to capture and hold the at least partially everted collar end flap of the pillowcase and the granular fill material in the plain end of the pillowcase.

When either the plain end or the collar end of the pillowcase is partially everted and folded into and beyond the then formed opening between the sides of the reversible fastening mechanism of the pillowcase, the two sides of the pillowcase containing the reversible fastening mechanism can be a reversible zipper or other reversibly connectable a fastener system such as buttons and buttonholes, Velcro-type hook and loop array system, or a projections-projection receiving snaps which maintain the configuration of the pillow in either a neck collar-type arrangement or a plain approximately rectangular arrangement.

Similarly the collar end and plain end described already can be equated to first and second geometric configurations between which a specially configured pillowcase may be transformed, for example a circular pillow and a square pillow.

The fill material is, preferably, granular-type buckwheat hulls, but may be any of the flowable, minimally compressible pillow-fill materials known to a person of ordinary skill in the art.

BRIEF DESCRIPTION OF THE DRAWINGS

FIG. 8 is a perspective view of a vertically-oriented pillowcase;

FIG. 9 is a cross sectional view of FIG. 8 and its orientation taken at 9—9 of FIG. 8;

FIG. 10 is a cross sectional view of the pillowcase of FIG. 9 having been placed in a horizontal position with its plain-end flap being partially everted toward the reversible fastening mechanism;

FIG. 11 is a perspective view of a transformable travel pillow according to the invention where the fill has been positioned in the collar end and the plain end flap has been partially everted and captured within the pillow case of the pillow by closure of the reversible fastening mechanism;

DETAILED DESCRIPTION

Figure 1:
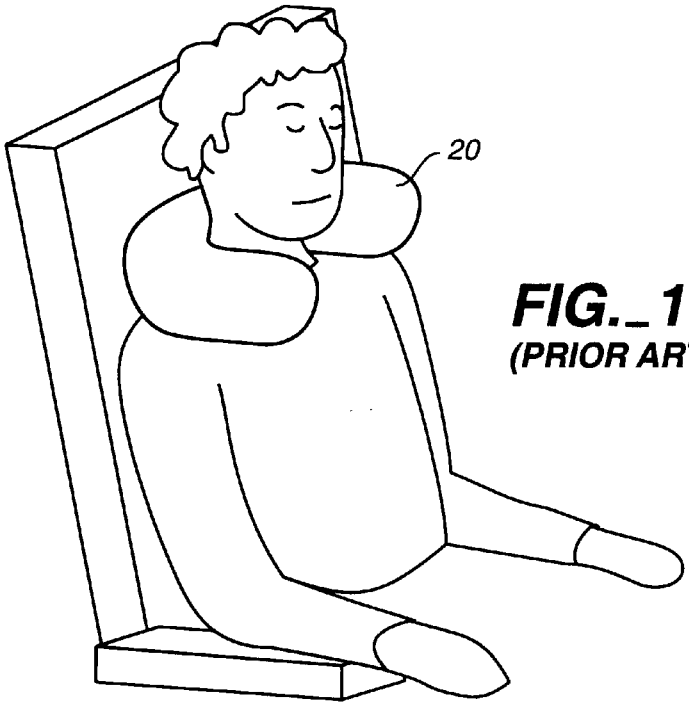
FIG. 1 (PRIOR ART)
FIG. 1 is perspective view of a traveler using a prior art travel neck pillow.
Figure 2:
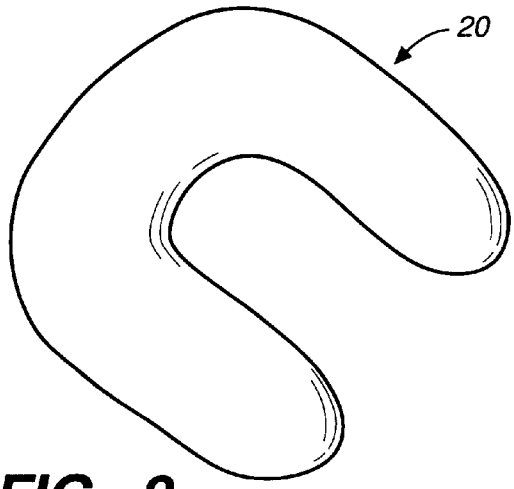
FIG. 2 (PRIOR ART)
FIG. 2 is a perspective view of the prior art travel neck pillow of FIG. 1.
Figure 3:
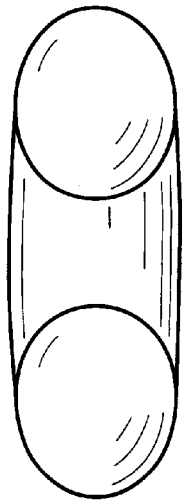
FIG. 3 (PRIOR ART)
FIG. 3 is an end view of the neck pillow of FIG. 2.
Figure 4:
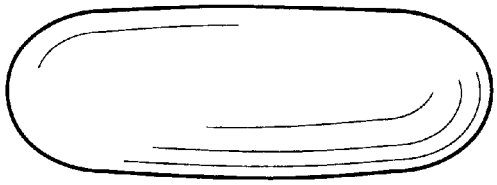
FIG. 4 (PRIOR ART)
FIG. 4 is a side view of the neck pillow of FIG. 2.
Figure 5:
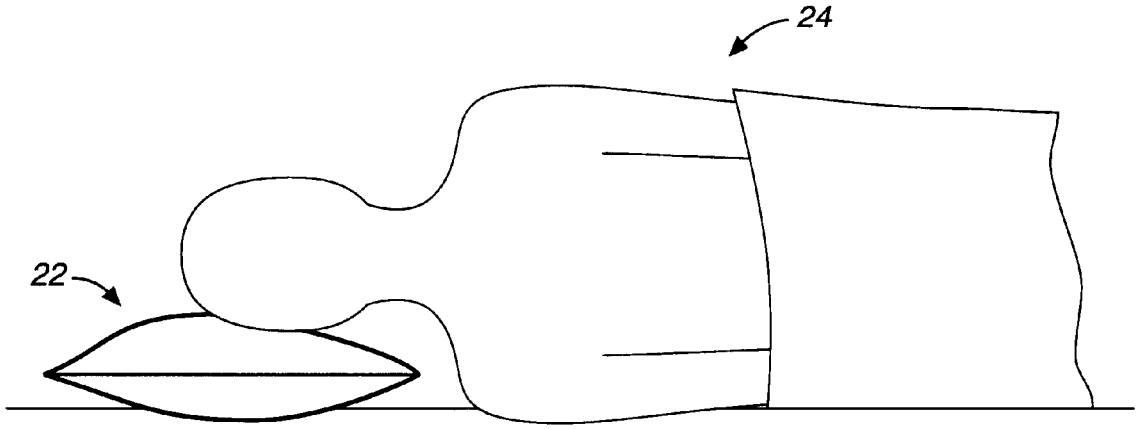
FIG. 5 (PRIOR ART)
FIG. 5 is an elevational view of a person sleeping on a conventional pillow.
Figure 6:
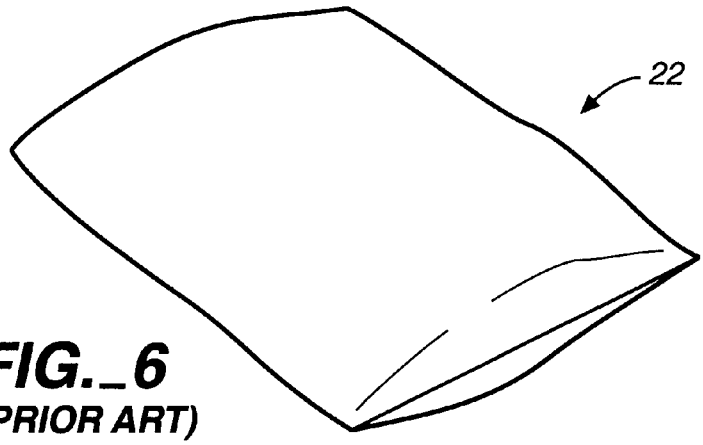
FIG. 6 (PRIOR ART)
FIG. 6 is a perspective view of a conventional pillow, as shown in FIG. 5.
Figure 7:
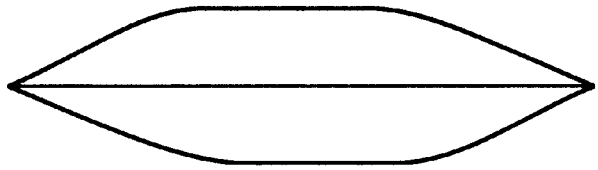
FIG. 7 (PRIOR ART)
FIG. 7 is an elevational view of the pillow of FIG. 5.
Figure 8:
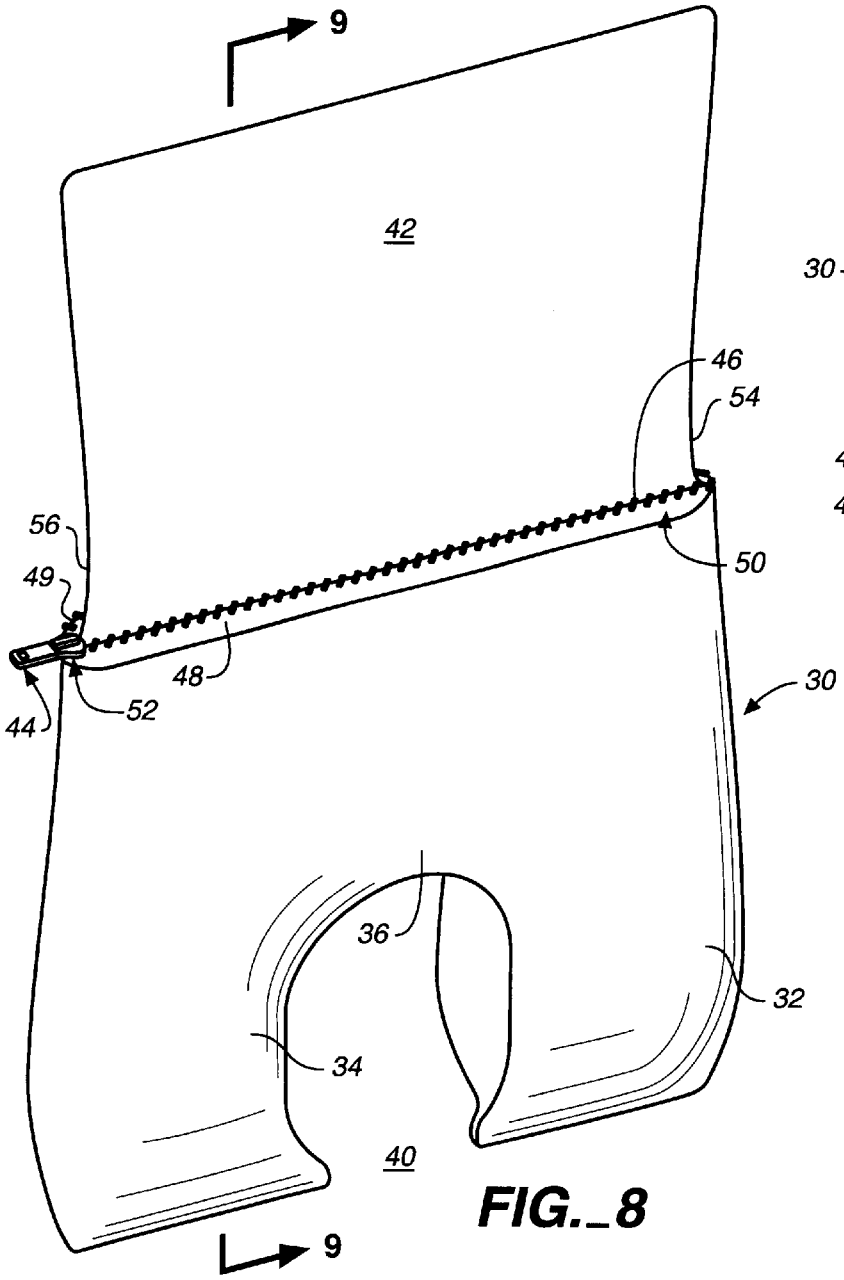
FIGS. 8, 9, 10 and 11 show a progression of steps of positioning the pillow fill at a collar end of the pillowcase to partially evert the plain end flap and capture it within the pillowcase to achieve a configuration as shown in FIGS. 11, 12, and 13.

A configuration according to the invention can be best understood by viewing a whole side of a pillowcase 30 as seen in FIG. 8. The pillowcase 30 has two tubular collar sections 32, 34 with a saddle section 36 between the collar sections. The pillowcase 30 has a collar end 40 separated from a plain end 42 by a reversible fastening mechanism system 44. Although a reversible zipper system 46 is shown in this embodiment, the two side connection flaps 48, 49 could be attached by any reversibly suitable fastening mechanism such as a button and button hole system, a hook and loop system, and a projection and projection receiving snap system (not shown). Also present but not shown is a zipper for accessing the fill within the containment volume of the pillowcase 30. (The pillowcase may contain an inner case which is separately sealed to contain the fill. Fill material may be added or removed to accommodate a user's pillow firmness preference.) The granular fill material can be buckwheat hulls, such as are well-known in the art Two sides of a reversible zipper system 46 are mounted to a reversible fastening mechanism flaps 48, 49 attached to the outside of the pillowcase between the collar end 40 and plain end 42. The reversible zipper system 46 and flaps 48, 49 act as a gate opening to contain the unfilled ends 40, 42 of the pillowcase 30 when the zipper is closed. The pillowcase material 54, 56 near the ends 50, 52 of the zipper system 46 bunches up the material at the sides of the pillowcase when the pillowcase material from the opposite end of the pillowcase is pulled through the zippered opening in preparation for transformation and partial evertion. The flap containing the reversible zipper system 46 or the button holes or other fastening systems, such as Velcro or snaps or similar systems, on one side of the flap will mate with the corresponding other half of its corresponding fastener system on the reversible fastening mechanism flap on the other side of the opening.

Figure 9:
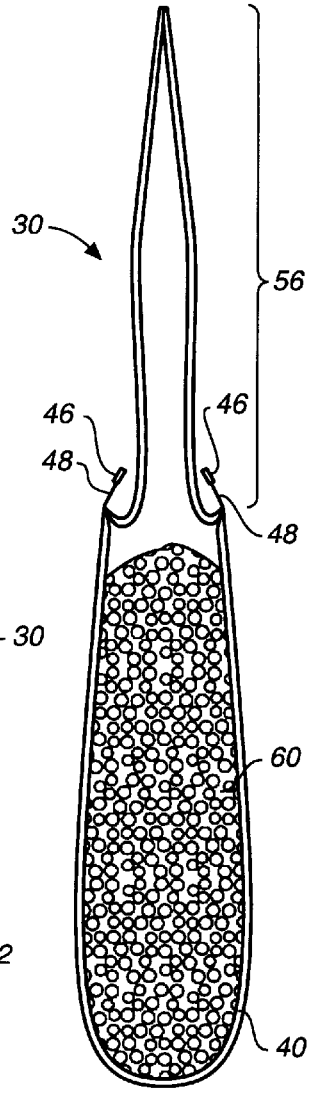
Figure 10:
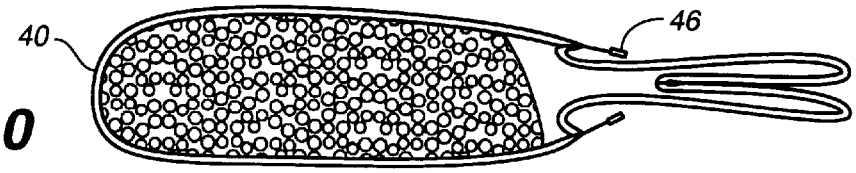
Figure 10A:
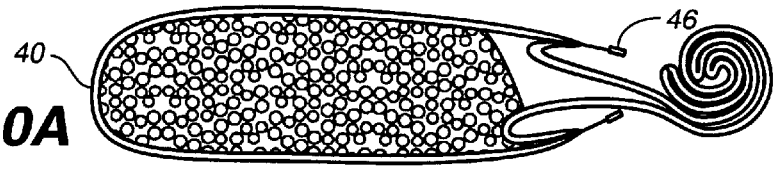
FIG. 10A is a cross sectional view of the pillowcase of FIG. 9 having been placed in a horizontal position with its plain-end flap shown being partially rolled up and bunched up as it is partially everted toward the reversible fastening mechanism.

A cross section of FIG. 8 is shown in FIG. 9. The fill material 60 only partially fills the pillowcase 30 such that the collar end of the pillowcase is substantially filled. The upper plain end of the pillowcase is substantially empty of fill material. Thus, the plain end flap 58 of the pillowcase is partially everted and rolled or folded or bunched up so that it ends up completely inside the opening formed by the reversible zipper and in the collar end of the pillowcase. Two of the many possible prospective progressions of folding and rolling to provide partial evertion are shown in FIGS. 10 and 10A.

Figure 11:
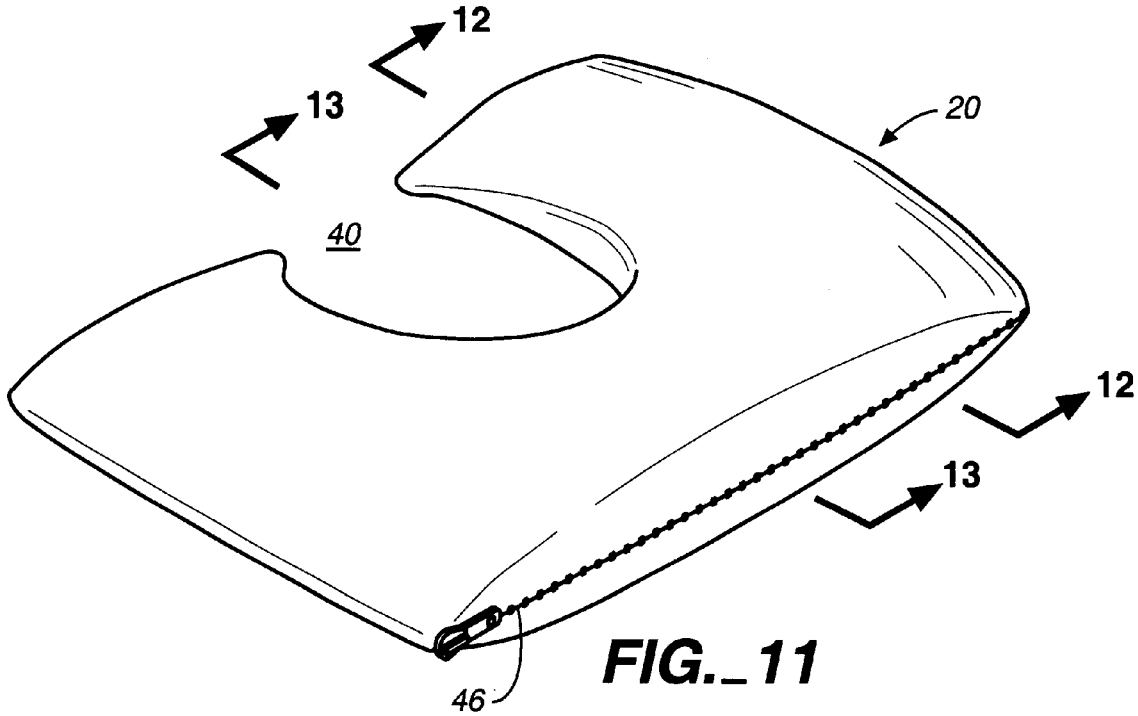

FIG. 11 shows a perspective view of a configuration according to the invention where the fill material is positioned at the collar end 40 and the reversible zipper system 46 is fully closed. This closure creates no fasteners on the sides of the pillowcase on which a user is likely to rest their head.

Figure 12:
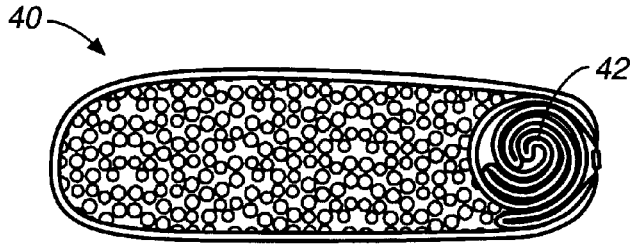
FIG. 12 is a cross sectional view of FIG. 11 taken at 12—12.

FIG. 12 shows a cross sectional view taken at 12—12 of FIG. 11 showing the fill material and the bunched up partially everted plain end flap 42 located within the collar end 40 of the pillowcase.

Figure 13:
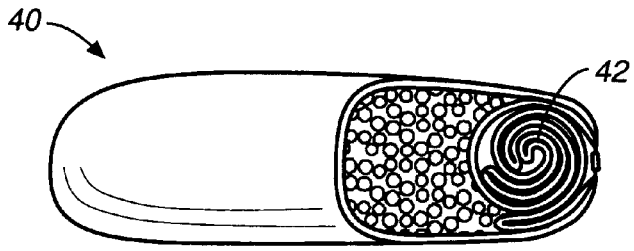
FIG. 13 is a cross sectional view of FIG. 11 taken at 13—13.

FIG. 13 shows a cross sectional view taken at 13—13 of FIG. 11 showing the fill material and the bunched up partially everted plain end flap 42 located within the collar end 40 of the pillowcase.

Figure 14:
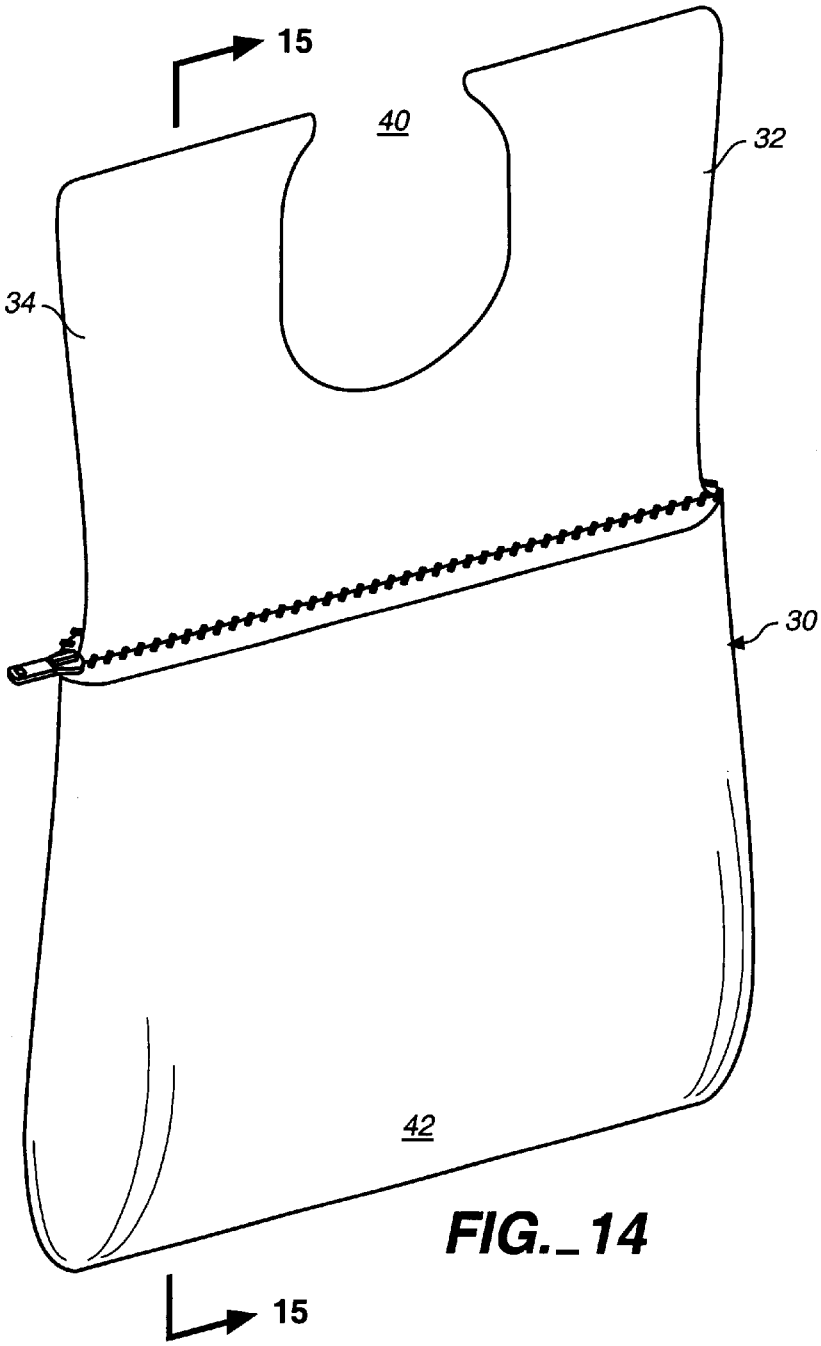
FIG. 14 is a perspective view of a pillowcase according to the invention with the two tubular collar sections raised so that the pillow fill material fills the plain end.
Figure 15:
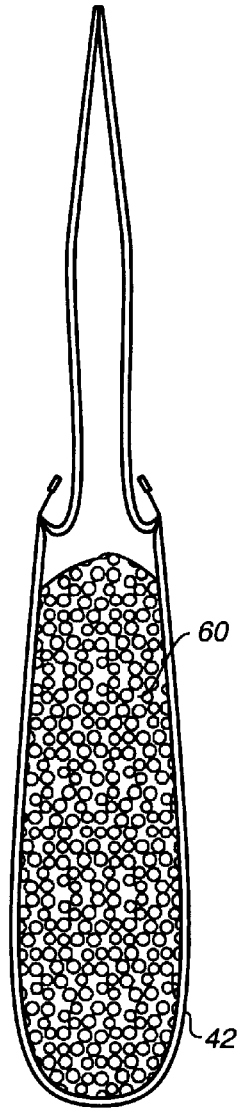
FIG. 15 is a cross sectional view of the fill material filling the plain end of the pillowcase.
Figure 16:
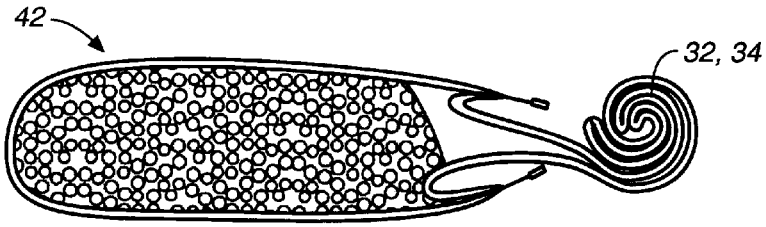
FIG. 16 shows the cross sectional view showing the pillowcase having been placed in a horizontal position, the two tubular collar sections being partially everted as they fold toward the reversible fastening mechanism opening in the plain end of the pillowcase.

FIG. 14 shows the inverted position of the pillowcase 30 hanging from the collar end 40 with the plain end 42 down. The fill material 60 is positioned at the plain end as seen in FIG. 15 taken at 15—15 of FIG. 14. Once the fill material 60 has been positioned in the plain end 42 of the pillowcase 30, the twin tubular sections 32, 34 (which are now empty) can be partially everted and folded or rolled or bunched up, as can be seen in FIG. 16, and positioned within the plain end 42 of the pillowcase.

Figure 17:
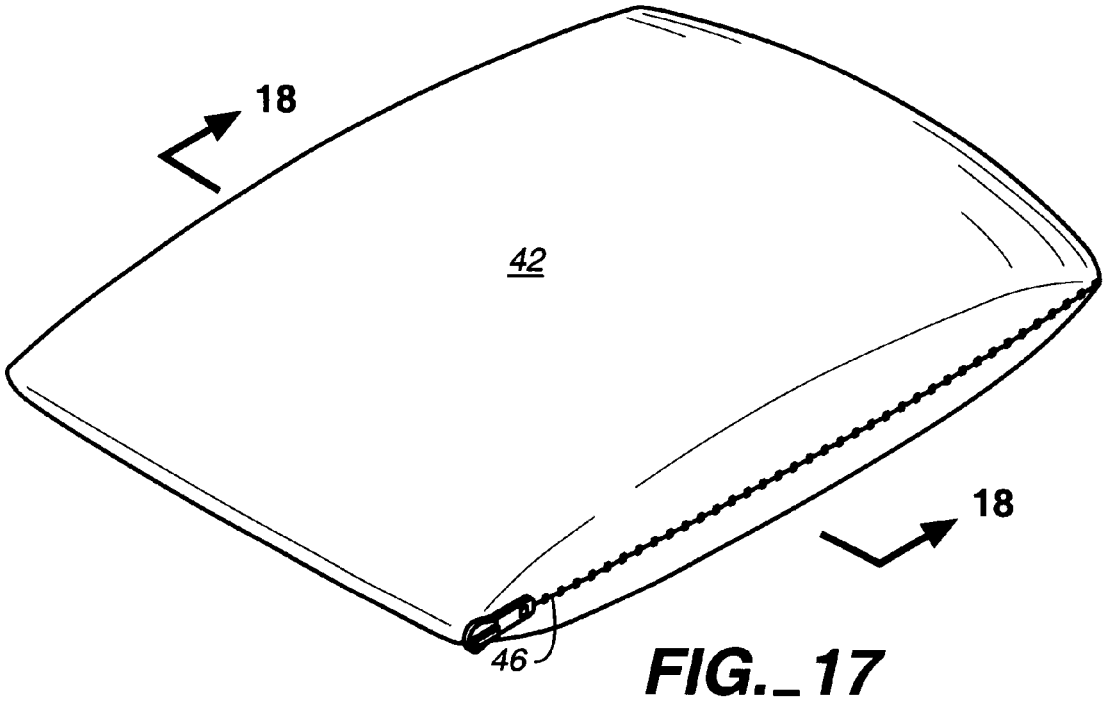
FIG. 17 is a perspective view of a transformable travel pillow according to the invention showing the pillow fill material filling the plain end with the two tubular collar sections having been partially everted in the pillowcase at the plain end of the pillow.

FIG. 17 shows a perspective view of the plain end pillowcase configuration ready for use.

Figure 18:
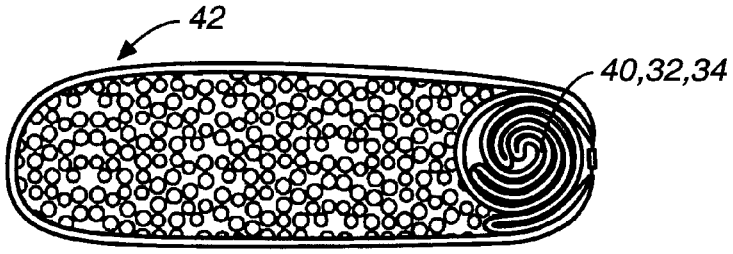
FIG. 18; shows a cross sectional view of FIG. 17 taken at 18—18.

FIG. 18 is a sectional view of FIG. 17 taken at 18—18. FIG. 18 shows the collar end flap of the pillowcase partially everted and captured within the plain end 42 of the pillowcase.

Figure 19:
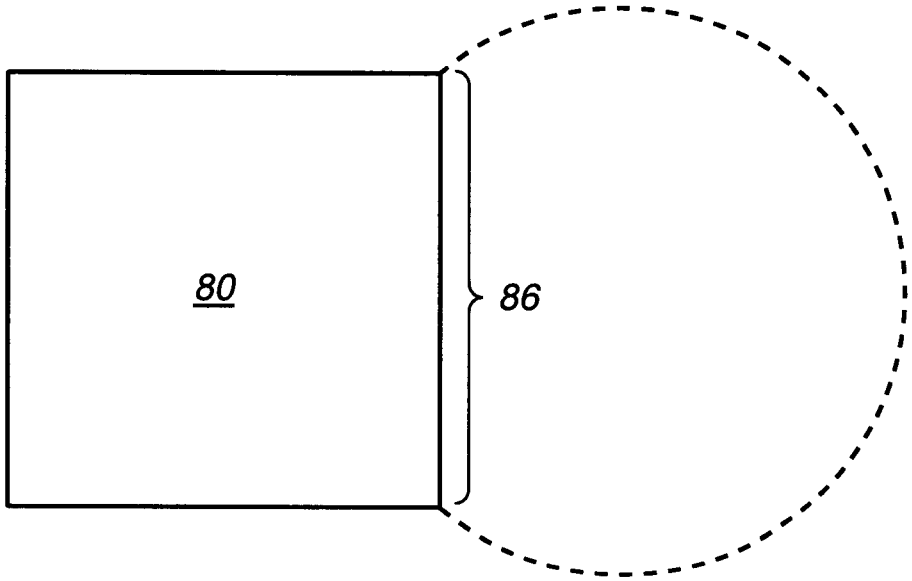
FIG. 19 shows a square pillow according to the invention, with a dashed line showing the outline of a circular pillowcase end to which it is mated.
Figure 20:
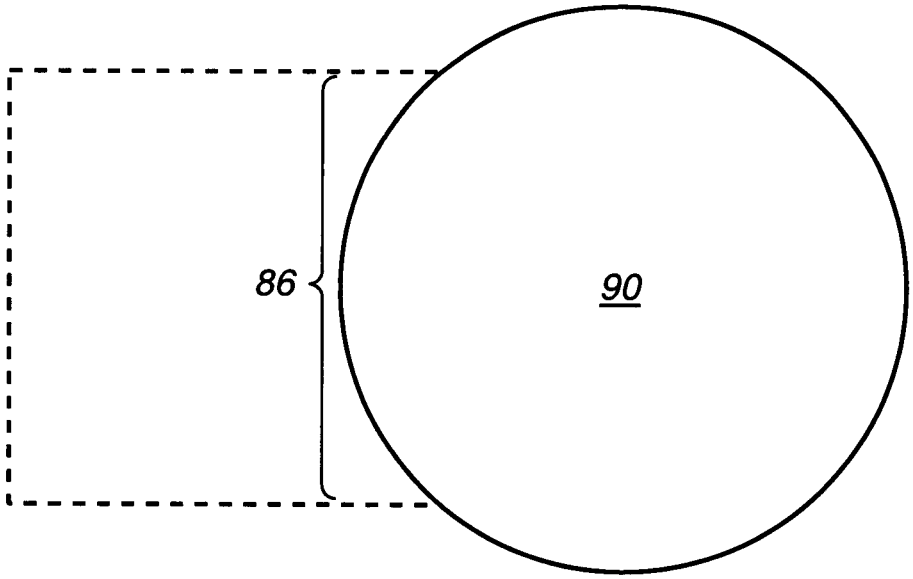
FIG. 20 shows the pillowcase of FIG. 19, with the circular end now being filled and a dashed line showing the outline of the square pillowcase end to which it is mated.

FIGS. 19 and 20 shows a configuration according to the invention where a square pillow configuration 80 can be transformed into a circular pillow configuration 90, just by allowing the granular flowable fill material to flow from one end to the other. Because the linear (perimeter) length 86 of the reversible fastening mechanism and the amount of fill material volume in each of the two configurations that needs to be contained is all that needs to be substantially equal. Only the imagination of the designer limits the number of configurations between which transformation can take place. Alternately, the transformation can be between two ends having the same geometric configuration, but because completely different outside surfaces are exposed to the user, the wear and tear time to replacement and/or time between cleanings can be virtually doubled without having to go to the trouble of removing the granular fill material and storing while the pillowcase is replaced or cleaned, and then having to replace the granular fill material within the pillowcase.

The invention includes a method of converting a neck pillow to a plain pillow comprising the steps of releasing a plain end flap of a pillowcase from its partially everted configuration within a pillowcase of the pillow by opening a reversible fastening mechanism system disposed between a collar end and a plain end, causing a fill of the pillow to flow from a set of two tubular collar sections which extend approximately in the same direction on two sides of a neck saddle portion of the pillowcase in a collar end of the pillowcase to a plain end of the pillowcase, thus leaving the two tubular collar sections substantially empty of fill and the plain end flap full of fill, partially everting the now substantially empty two tubular collar sections and placing them in the plain end of the pillow with in an opening formed by two sides of the reversible fastening mechanism, and closing the reversible fastening mechanism to capture the collar end with its set of two tubular collar sections on two sides of the neck saddle portion within the pillowcase in a the plain configuration.

A similar apparatus and method are used to provide a geometric transformation of a first geometric end configuration to a second geometric end configuration, where the end configurations can be similar or substantially different, for example an ellipse or circular pillow can transform to a polygon, rectangle, square, or star, for example.

While the invention has been described with regard to the specific embodiments, those skilled in the art will recognize that changes can be made in form and detail without departing from the spirit and scope of the invention.

What is claimed is:

1. A convertible neck pillow comprising:

a pillowcase enclosing a particular volume of a granular fill material;

wherein said pillowcase includes a collar end and a plain end, with two sides of a reversible fastening mechanism system disposed between said collar end and said plain end, wherein said pillowcase at said collar end includes two tubular collar sections extending approximately in the same direction with a saddle section sized to receive the neck of a person extending between the two tubular collar sections;

wherein the size of said pillowcase is such that when said granular fill material is positioned to substantially fill said collar end of said pillowcase, said two tubular collar sections of said pillowcase and said saddle section, are substantially full of granular material, while granular fill material is substantially absent from said plain end of said pillowcase, such that a plain end flap of said pillowcase can be at least partially everted and positioned within said collar end of said pillowcase and said two sides of said reversible fastening mechanism system joined to capture and hold the at least partially everted plain end flap of said pillowcase and the granular fill material in said collar end of said pillowcase;

when said granular fill material is positioned to substantially fill said plain end of said pillowcase, said plain end of said pillowcase is substantially full of granular material, while granular fill material is substantially absent from said two tubular collar sections and said saddle section at said collar end of said pillowcase, such that a collar end flap, including said two tubular collar sections and said saddle section of said pillowcase, can be at least partially everted and positioned within said plain end of said pillowcase and said two sides of said reversible fastening mechanism system joined to capture and hold the at least partially everted collar end flap of said pillowcase and the granular fill material in said plain end of said pillowcase.

2. The convertible neck pillow as in claim 1, wherein the reversible fastening mechanism system is a reversible zipper system.

3. The convertible neck pillow as in claim 1, wherein the reversible fastening mechanism system is a button and button hole system.

4. The convertible neck pillow as in claim 1, wherein the reversible fastening mechanism system is a hook and loop system.

5. The convertible neck pillow as in claim 1, wherein the reversible fastening mechanism system is a projection and projection receiving snap system.

6. The convertible neck pillow as in claim 1, wherein said granular fill material is buckwheat hulls.

7. A convertible neck pillow comprising:

a pillowcase enclosing a particular volume of a granular fill material;

wherein said pillowcase includes a collar end and a plain end, with two sides of a reversible fastening mechanism system disposed between said collar end and said plain end, wherein said pillowcase at said collar end includes two tubular collar sections extending approximately in the same direction with a saddle section sized to receive the neck of a person extending between the two tubular collar sections;

wherein the size of said pillowcase is such that when said granular fill material is positioned to substantially fill said collar end of said pillowcase, said two tubular collar sections of said pillowcase and said saddle section, are substantially full of granular material, while pillowcase material forming a plain end flap of said pillowcase is at least partially everted and positioned within said collar end of said pillowcase and said two sides of said reversible fastening mechanism system joined to capture and hold the at least partially everted plain end flap of said pillowcase and the granular fill material in said collar end of said pillowcase;

when said granular fill material is positioned to substantially fill said plain end of said pillowcase, said plain end of said pillowcase is substantially full of granular material, while pillowcase material forming a collar end flap of said pillowcase is at least partially everted and positioned within said plain end of said pillowcase and said two sides of said reversible fastening mechanism system joined to capture and hold the at least partially everted collar end flap of said pillowcase and the granular fill material in said plain end of said pillowcase.

8. The convertible neck pillow as in claim 7, wherein the reversible fastening mechanism system is a reversible zipper system.

9. The convertible neck pillow as in claim 7, wherein the reversible fastening mechanism system is a button and button hole system.

10. The convertible neck pillow as in claim 7, wherein the reversible fastening mechanism system is a hook and loop system.

11. The convertible neck pillow as in claim 7, wherein the reversible fastening mechanism system is a projection and projection receiving snap system.

12. The convertible neck pillow as in claim 7, wherein said granular fill material is buckwheat hulls.

13. A method of converting a neck pillow to a plain pillow comprising the steps of releasing a plain end flap of a pillowcase from its partially everted configuration within a pillowcase of said pillow by opening a reversible fastening mechanism system disposed between a collar end and a plain end;

causing a fill of said pillow to flow from a set of two tubular collar sections which extend approximately in the same direction on two sides of a neck saddle portion of said pillowcase in a collar end of said pillowcase to a plain end of said pillowcase, thus leaving the two tubular collar sections substantially empty of fill and said plain end flap full of fill;

partially everting the now substantially empty two tubular collar sections and placing them in said plain end of said pillow within an opening formed by two sides of said reversible fastening mechanism; and closing said reversible fastening mechanism to capture said collar end with its set of two tubular collar sections on two sides of the neck saddle portion within said pillowcase in a plain configuration.

14. A geometrically transformable pillow comprising:

a pillowcase enclosing a particular volume of a granular fill material;

wherein said pillowcase includes a first configuration end and a second configuration end, with two sides of a reversible fastening mechanism system disposed between said first configuration end and said second configuration end, wherein said pillowcase at said first configuration end includes a first geometrically shaped pillowcase outline and said pillowcase at said second configuration end includes a second geometrically shaped pillowcase outline;

wherein the size of said pillowcase is such that when said granular fill material is positioned to substantially fill said first configuration end of said pillowcase, the containment volume of said first geometrically shaped pillow case outline is substantially full of granular material, while granular fill material is substantially absent from said second configuration end of said pillowcase, such that a second configuration end flap of said pillowcase can be at least partially everted and positioned within said first configuration end of said pillowcase and said two sides of said reversible fastening mechanism system joined to capture and hold the at least partially everted second configuration end flap of said pillowcase and the granular fill material in said first configuration end of said pillowcase;

when said granular fill material is positioned to substantially fill said second configuration end of said pillowcase, said second configuration end, the containment volume of said second geometrically shaped pillowcase outline is substantially full of granular material, while granular fill material is substantially absent from said first configuration end of said pillowcase, such that a first configuration end flap, can be at least partially everted and positioned within said second configuration end of said pillowcase and said two sides of said reversible fastening mechanism system joined to capture and hold the at least partially everted first configuration end flap of said pillowcase and the granular fill material in said second configuration end of said pillowcase.

15. The geometrically transformable pillow as in claim 14, wherein the reversible fastening mechanism system is a reversible zipper system.

16. The geometrically transformable pillow as in claim 14, wherein the reversible fastening mechanism system is a button and button hole system.

17. The geometrically transformable pillow as in claim 14, wherein the reversible fastening mechanism system is a hook and loop system.

18. The geometrically transformable pillow as in claim 14, wherein the reversible fastening mechanism system is a projection and projection receiving snap system.

19. The geometrically transformable pillow as in claim 14, wherein said granular fill material is buckwheat hulls.

20. The geometrically transformable pillow as in claim 14, wherein said first geometric configuration has a substantially elliptical outline on two opposite sides and said second geometric configuration has a substantially polygonal outline on two opposite sides.

21. The geometrically transformable pillow as in claim 20, wherein said first geometric configuration has a substantially circular outline on two opposite sides and said second geometric configuration has a substantially rectangular outline on two opposite sides.

22. A method of converting a first geometric configuration pillow to a second geometric configuration pillow comprising the steps of:

releasing a second configuration end flap of a pillowcase from its partially everted configuration within a pillowcase of said pillow by opening a reversible fastening mechanism system disposed between a first geometric configuration end and a second geometric configuration end;

causing a fill of said pillow to flow from said first configuration end of said pillowcase to a second configuration end of said pillowcase, thus leaving the first configuration end of said pillowcase substantially empty of fill and said second configuration end flap full of fill;

partially everting the now substantially empty first configuration end flap and placing it within said second configuration end of said pillow within an opening formed by two sides of said reversible fastening mechanism; and closing said reversible fastening mechanism to capture said first configuration end within said pillowcase in a said second end configuration.

* * * * *